US012042835B2

(12) United States Patent
Tachibana

(10) Patent No.: US 12,042,835 B2
(45) Date of Patent: Jul. 23, 2024

(54) ROLLING CONTROL SYSTEM AND ROLLING CONTROL METHOD

(71) Applicant: TMEIC Corporation, Tokyo (JP)

(72) Inventor: Minoru Tachibana, Tokyo (JP)

(73) Assignee: TMEIC CORPORATION, Tokyo (JP)

( * ) Notice: Subject to any disclaimer, the term of this patent is extended or adjusted under 35 U.S.C. 154(b) by 148 days.

(21) Appl. No.: 17/427,671

(22) PCT Filed: Jan. 15, 2020

(86) PCT No.: PCT/JP2020/001065
§ 371 (c)(1),
(2) Date: Aug. 2, 2021

(87) PCT Pub. No.: WO2021/144882
PCT Pub. Date: Jul. 22, 2021

(65) Prior Publication Data
US 2022/0126340 A1 Apr. 28, 2022

(51) Int. Cl.
*B21B 37/16* (2006.01)
*B21B 37/58* (2006.01)

(52) U.S. Cl.
CPC ..... *B21B 37/16* (2013.01); *B21B 37/58* (2013.01)

(58) Field of Classification Search
CPC ..... B21B 37/16; B21B 37/58; B21B 37/18; B21B 37/48; B21B 37/46; B21B 2275/04; B21B 2271/02; B21B 2261/00
USPC ..... 72/12.8
See application file for complete search history.

(56) References Cited

FOREIGN PATENT DOCUMENTS

| | | | |
|---|---|---|---|
| JP | 11-197728 | A | 7/1999 |
| JP | 2015-112614 | A | 6/2015 |
| JP | 2016-93828 | A | 5/2016 |
| JP | 2016-221553 | A | 12/2016 |

OTHER PUBLICATIONS

Machine translation of JP 2015112614 A (Year: 2015).*
Machine translation of JP H11197728 A (Year: 1999).*
Office Action issued on Jul. 26, 2022, in corresponding Japanese patent Application No. 2021-571111, 8 pages.
Office Action issued on Aug. 19, 2022, in corresponding Indian patent Application No. 202117032131, 5 pages.
International Search Report and Written Opinion mailed on Feb. 18, 2020, received for PCT Application PCT/JP2020/001065, Filed on Jan. 15, 2020, 9 pages.
(Continued)

*Primary Examiner* — Christopher L Templeton
*Assistant Examiner* — Teresa A Guthrie
(74) *Attorney, Agent, or Firm* — XSENSUS LLP

(57) ABSTRACT

A rolling controller executes speed and tension control, and roll gap and plate thickness control when rolling speed is less than a boundary value, while executing roll gap and plate tension control, and speed and plate thickness control when the rolling speed is equal to or greater than the boundary value. If the rolling speed rises across the boundary value, the rolling controller sets the rolling speed to zero such that a speed correction amount in the speed and tension control before the transboundary is not reflected to a calculation executed in the speed control amount of the rolling speed after the transboundary.

9 Claims, 6 Drawing Sheets

(56) References Cited

OTHER PUBLICATIONS

Office Action issued Jan. 31, 2023 in Korean Patent Application No. 10-2021-7023675, 9 pages.
International Preliminary Report on Patentability issued Jul. 19, 2022 in PCT/JP2020/001065, 6 pages. (Submitting English translation only).
Office Action issued on Aug. 17, 2022, in corresponding Korean patent Application No. 10-2021-7023675, 9 pages.
Office Action issued on Jul. 28, 2021, in corresponding Taiwanese patent Application No. 109115218, 15 pages.
Office Action issued on Oct. 17, 2023, in corresponding Vietnamese patent Application No. 1-2021-04759, 3 pages.
Hearing Notice issued Dec. 6, 2023 in corresponding Indian Patent Application No. 202117032131 (English translation included).

* cited by examiner $$k_b = \frac{1}{M+Q}\frac{\partial P}{\partial T_b}$$

$$T_r = -\frac{1}{E_b H}\frac{1}{k_b}\frac{h}{V_e}$$

$$Q = \frac{\partial P}{\partial h}$$

ROLLING CONTROL SYSTEM AND ROLLING CONTROL METHOD

CROSS-REFERENCE TO RELATED APPLICATION

The present application is based on PCT filing PCT/JP2020/001065, filed Jan. 15, 2020, the entire contents of which are incorporated herein by reference.

FIELD

The present invention relates to a rolling control system and a rolling control method.

BACKGROUND

In a rolling operation, various types of rolling control are executed such that actual measurement values relating to a process of a material to be rolled match respective target values. The rolling control includes a so-called automatic gauge control (hereinafter also referred to as "AGC") in which a plate thickness in a delivery side of a rolling mill having an affect on a product quality is kept constant in order to bring the plate thickness of the material to be rolled to a desired plate thickness. The rolling control also includes a so-called automatic tension regulator control (hereinafter referred to as "ATR") in which a tension applied to the material to be rolled is kept constant in an entry side and the delivery side of the rolling mill in order to maintain the product quality and secure an operation stability.

JP2016-93828A discloses a rolling control system in which the AGC and the ATR are switched in accordance with rolling speed of the material to be rolled. The prior art system selects a first control method when the rolling speed is slow whereas a second control method when the rolling speed is fast. In the first control method, the ATR is executed in which the speed of the material to be rolled is controlled such that the entry-side tension of the rolling mill matches a target value and the AGC is executed in which a roll gap of the rolling mill is controlled such that a delivery-side plate thickness matches a target value. In the second control method, the ATR is executed in which the roll gap is controlled such that the entry-side tension matches the target value and the AGC is executed in which the speed of the material to be rolled is controlled such that the delivery-side plate thickness matches the target value.

In the conventional system, when switching from the first control method to the second control method, a deviation between an entry-side tension prior to switching and a target value in the ATR is adjusted. Specifically, when the entry-side tension deviation is within a predetermined range, the entry-side tension deviation is changed to zero. When the entry-side tension deviation is out of the predetermined range, an e entry-side tension deviation is changed to a value obtained by subtracting the predetermined value from the entry-side tension deviation. As a result, it is possible to prevent the AGC control amount after switching from becoming excessive as compared with a case where the entry-side tension deviation is not adjusted.

CITATION LIST

Patent Literature

[PLT 1] JP2016-93828A

SUMMARY

Technical Problems

As described above, in the conventional system, the entry-side tension deviation is adjusted when the control method is switched as the rolling speed increases. However, even if the entry-side tension deviation is adjusted, the adjusted entry-side tension deviation is used to calculate the control amount of the AGC after the switching. Therefore, when the entry-side tension deviation immediately before the switching largely deviates from the predetermined range, the control amount of AGC after the switching may conflict with an upper restriction. This may hinder a continuation of the AGC after the switching.

The present invention has been made to solve the above-mentioned problems, and an object of the present invention is to provide a technique capable of avoiding a situation where it is difficult to continue the AGC after the switching when the switching from the ATR to the AGC is performed in accompany with the increase in the rolling speed.

Solution to Problems

A first aspect of the present invention is a rolling control system to achieve the above-mentioned object and has the following features.

The control system comprises a rolling stand and a rolling controller.

The rolling controller is configured to execute speed control of which a control operation terminal is speed of a material to be rolled in an entry side of the rolling stand and roll gap control of which a control operation terminal is a roll gap of the rolling stand.

The rolling controller includes: a first plate thickness control part; a second plate thickness control part; a first tension control part; a second tension control part; and a control selection part.

The first plate thickness control part is configured to execute roll gap and plate thickness control that is roll gap control to control a plate thickness of the material to be rolled in a delivery side of the rolling stand.

The second plate thickness control part is configured to execute speed and plate thickness control that is speed control to control the plate thickness.

The first tension control part is configured to execute speed and tension control to control a tension of the material to be rolled in the entry side of the rolling stand.

The second tension control part is configured to execute roll gap and plate tension control to control the tension.

The control selection part is configured to select the speed and tension control and the roll gap and plate thickness control if rolling speed is less than a boundary value, while selecting the roll gap and plate tension control and the speed and plate thickness control if the rolling speed is greater than or equal to the boundary value.

The control selection part is further configured to, if the rolling speed rises across the boundary value, set a speed correction amount to zero and then output it to the second tension control part such that the speed correction amount in the speed and tension control before the transboundary is not reflected to a calculation executed in the speed control amount of the rolling speed at the transboundary.

A second invention has the following feature in the first invention.

The control selection part is further configured to, if the rolling speed rises across the boundary value, calculate a roll gap correction amount according to the speed correction amount and then output it to the second tension control part such that the speed correction amount is reflected to a calculation of a roll gap control amount executed in the roll gap and plate tension control at the transboundary.

A third aspect of the present invention is a rolling control method to achieve the above-mentioned object and has the following features.

The rolling control method is a method comprising the steps of: executing speed control of which a control operation terminal is rolling speed; and executing roll gap control of which a control operation terminal is a roll gap of a rolling stand.

The roll gap control includes roll gap and plate thickness control, and roll gap and plate tension control. The roll gap and plate thickness control is the roll gap control to control a plate thickness of a material to be rolled in a delivery side of the rolling stand. The roll gap and plate tension control is the roll gap control to control a tension of the material to be rolled in an entry side of the rolling stand.

The speed control includes speed and tension control, and speed and plate thickness control. The speed and tension control is the speed control to control the tension. The speed and plate thickness control is the speed control to control the plate thickness.

The rolling control method further comprising the steps of:

- selecting, if rolling speed of the material to be rolled is less than a boundary value, the speed and tension control and the roll gap and plate thickness control;
- selecting, if the rolling speed is greater than or equal to the boundary value, the roll gap and plate tension control and the speed and plate thickness control; and
- setting a speed correction amount to zero, if the rolling speed rises across the boundary value, such that the speed correction amount in the speed and tension control before the transboundary is not reflected to a calculation executed in the speed control amount of the rolling speed at the transboundary.

A fourth invention further has the following feature in the third invention.

The rolling control method further comprising a step of calculating, if the rolling speed rises across the boundary value, a roll gap correction amount according to the speed correction amount such that the speed correction amount is reflected to a calculation of a roll gap control amount executed in the roll gap and plate tension control at the transboundary.

Effects of Invention

According to the first or the third invention, if the rolling speed rises across the boundary value, the speed correction amount is set to zero such that the speed correction amount of the speed and tension control before the transboundary is not reflected to the calculation of the speed control amount of the speed and plate thickness control at the transboundary of the rolling speed. Therefore, it is possible to avoid a situation where the speed control amount of the speed and plate thickness control calculated at the transboundary of the rolling speed conflicts with an upper restriction. Therefore, it is possible to avoid a situation where it becomes difficult to continue the speed and plate thickness control after the transboundary of the rolling speed.

According to the second or the fourth invention, if the rolling speed rises across the boundary value, the roll gap correction amount according to the speed correction amount is calculated such that the speed correction amount is reflected to the calculation in the roll gap control amount of the roll gap and plate tension control at the transboundary. Therefore, it is possible to prevent the tension of the material to be rolled in the entry side of the rolling stand from fluctuating significantly after the transboundary of the rolling speed.

EMBODIMENT OF EMBODIMENT

Hereinafter, an embodiment of the present invention will be described in detail with reference to the drawings.

1. Configuration of Rolling Control System

Figure 1:
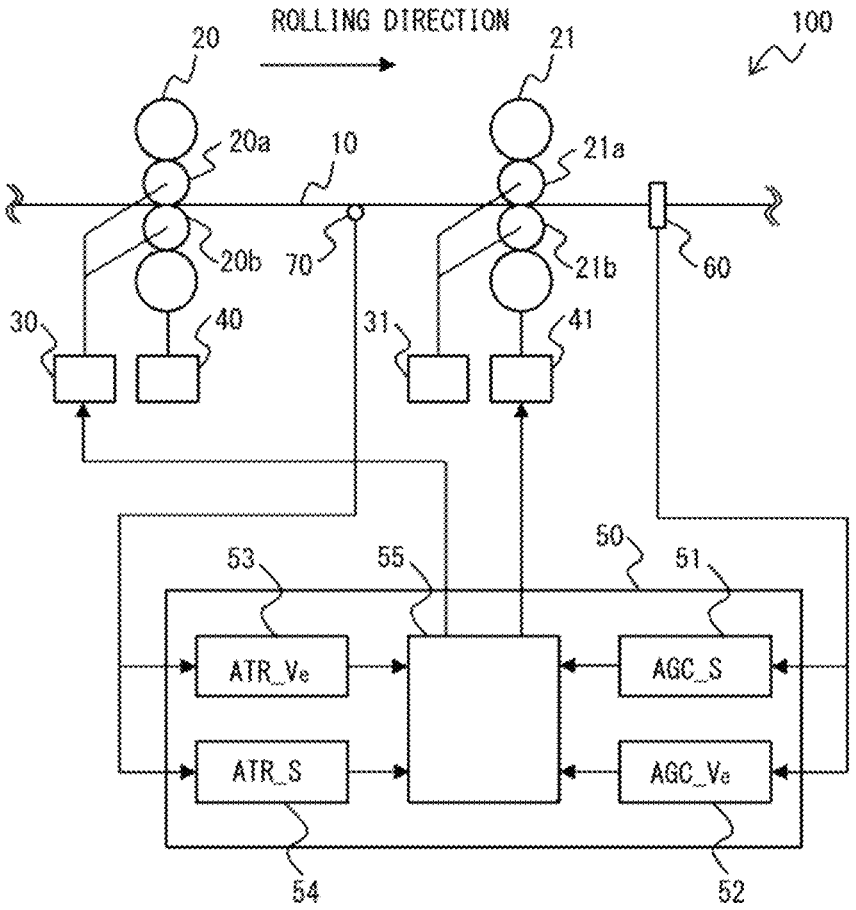
FIG. 1 is a diagram for explaining a configuration example of a rolling control system according to an embodiment.

FIG. 1 is a diagram illustrating a configuration example of a rolling control system according to the embodiment. A rolling control system 100 shown in FIG. 1 comprises rolling stands to roll a material to be rolled 10. The rolling stands includes a rolling stand 20 provided in a preceding stage of a rolling direction of the material to be rolled 10 and a rolling stand 21 provided in a following stage of the rolling direction. The rolling stands 20 and 21 constitute a tandem rolling mill. The total number of the rolling stands constituting the tandem rolling mill may be three or more. The rolling stand 20 has work rolls 20*a* and 20*b* sandwiching the material to be rolled 10. The rolling stand 21 has work rolls 21*a* and 21*b*.

Figure 2:
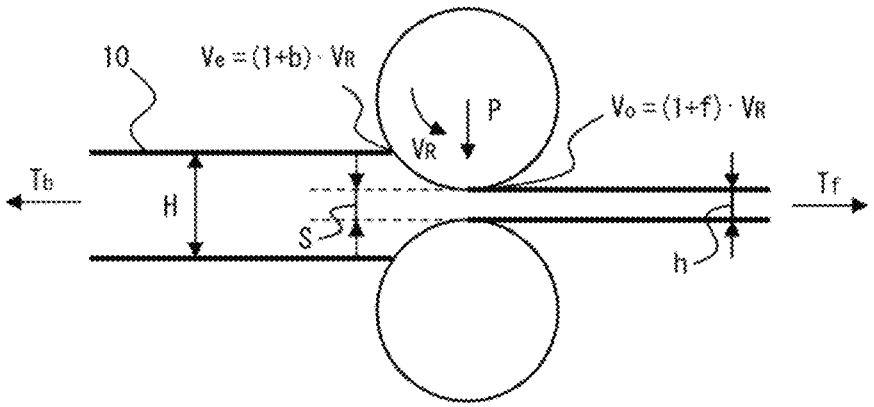
FIG. 2 is a diagram showing a rolling phenomenon in the rolling stand and parameters related thereto.

A rolling is performed by crushing the material to be rolled 10 with a pair of the work rolls. FIG. 2 is a diagram showing a rolling phenomenon in a rolling stand and related parameters. As shown in FIG. 2, the material to be rolled 10 is pulled by a tension Tb in an entry side of the rolling stand, and a tension Tf in a delivery side of the same rolling stand, and is crushed by a load P. This reduces a plate thickness H of the material to be rolled to a plate thickness h. This rolling phenomenon generates a load P, a forward slip f and a backward slip b. Velocity Ve of the material to be rolled 10 in the entry side of the rolling stand is expressed by the backward slip b and work roll speed VR. Velocity Vos of the material to be rolled 10 in the delivery side of the rolling stand is expressed by the forward slip f and the work roll speed VR.

Returning to FIG. 1, the explanation of the rolling control system 100 will be continued. The rolling stand 20 has a speed controller 30 which controls the work roll speed VR at the work rolls 20*a* and 20*b*. The rolling stand 20 also has a roll gap controller 40 which controls a roll gap S, being a distance between the work rolls 20*a* and 20*b*. Like the rolling stand 20, the rolling stand 21 has a speed controller 31 and a roll gap controller 41. The speed controller 31 controls the work roll speed VR of the rolling stand 21. The roll gap controller 41 controls the roll gap S of the rolling stand 21. These controllers are connected to a rolling controller 50. A configuration of the rolling controller 50 will be described later.

In the rolling, the plate thickness of the material to be rolled 10 is critical to the quality of the product. Therefore, on the delivery side of the rolling stand 21, a plate thickness meter 60 is provided to measure the plate thickness of the material to be rolled 10. It is also important in the rolling to maintain a quality of a product and to secure an operation stability. For this reason, a tension meter 70 is provided between the rolling stands 20 and 21. The plate thickness meter 60 and the tension meter 70 are connected to the rolling controller 50. Note that a plate thickness meter having the same configuration as that of the plate thickness meter 60 may be provided on the entry side and the delivery side of the rolling stand 20. A tension meter having the same configuration as that of the tension meter 70 may be provided on the entry side of the rolling stand 20 or the delivery side of the rolling stand 21.

2. Configuration of Rolling Controller

The rolling controller 50 includes a first plate thickness control part 51, a second plate thickness control part 52, a first tension control part 53, a second tension control part 54, and a control selection part 55.

The first plate thickness control part 51 executes roll gap and plate thickness control (hereinafter also referred to as "AGC_S"). The AGC_S is the AGC for controlling the plate thickness of the material to be rolled 10 in the delivery side of the rolling stand 21 (i.e., the plate thickness h shown in FIG. 2) by using the roll gap S of the rolling stand 21 as a control operation terminal. The AGC_S is executed when the rolling speed is less than a boundary value TH.

The second plate thickness control part 52 executes speed and plate thickness control (hereinafter also referred to as "AGC_Ve"). The AGC_Ve is the AGC for controlling the plate thickness of the material to be rolled 10 in the delivery side of the rolling stand 21 by using the velocity Ve of the material to be rolled 10 in the entry side of the rolling stand 21 as a control operation terminal. The AGC_Ve is executed when the rolling speed is greater than or equal to the boundary value TH.

The first tension control part 53 executes speed and tension control (hereinafter also referred to as "ATR_Ve"). The ATR_Ve is the ATR for controlling the tension of the material to be rolled 10 between the rolling stands 20 and 21 (i.e., the entry side of the rolling stand 21) by using the speed Ve of the material to be rolled 10 in the entry side of the rolling stand 21 as a control operation terminal. The ATR_Ve is executed when the rolling speed is less than the boundary value TH.

The second tension control part 54 executes the roll gap and plate tension control (hereinafter also referred to as "ATR_S"). The ATR_S is the ATR for controlling the tension of the material to be rolled 10 between the rolling stands 20 and 21 by using the roll gap S of the rolling stand 21 as a control operation terminal. The ATR_S is executed when the rolling speed is greater than or equal to the boundary value TH.

Figure 3:
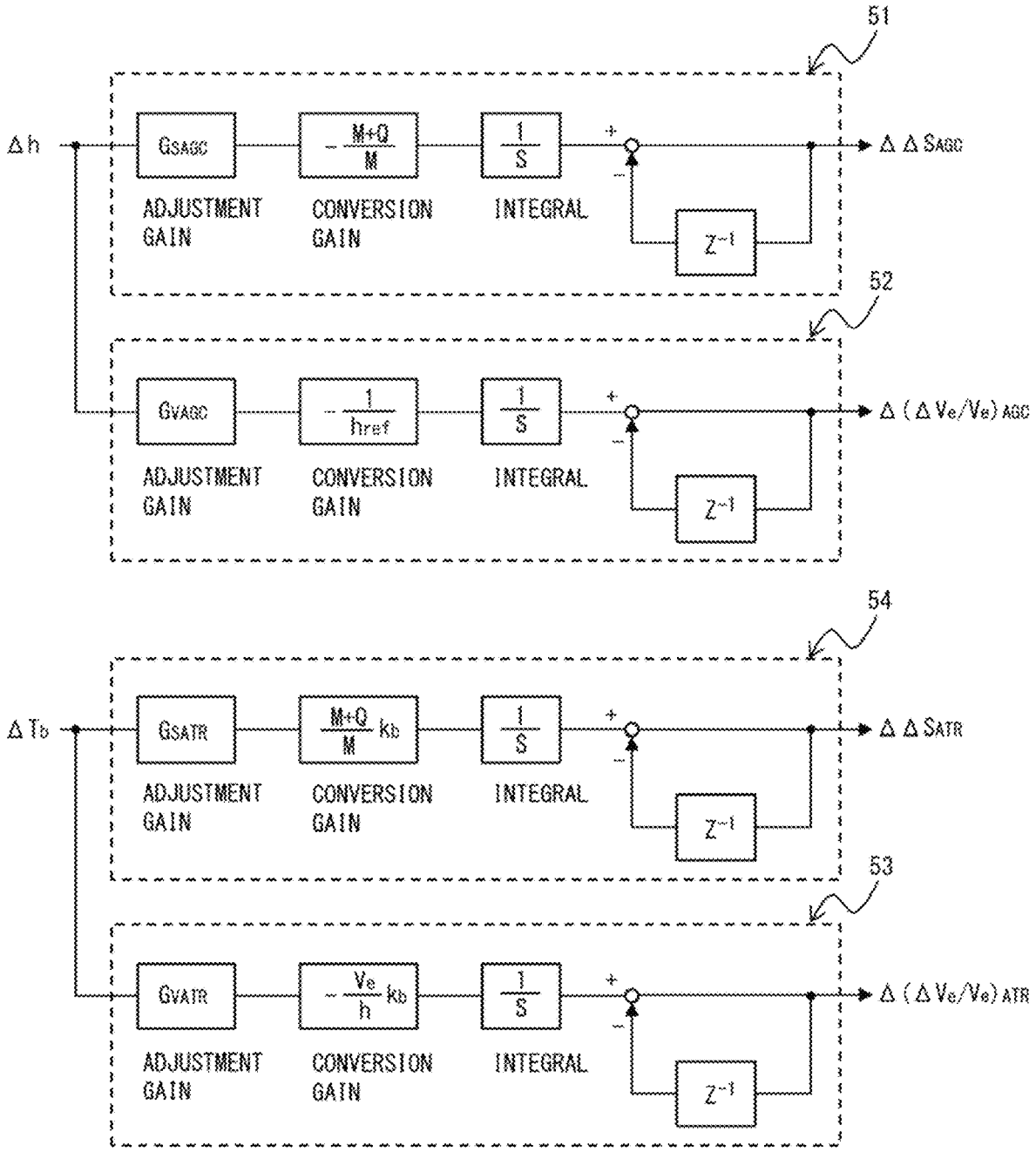
FIG. 3 is a block diagram showing a configuration of a first plate thickness control part, a second plate thickness control part, a first tension control part, and a second tension control part shown in FIG. 1.

FIG. 3 is a block diagram showing a configuration of the first plate thickness control part 51, the second plate thickness control part 52, the first tension control part 53 and the second tension control part 54. These block diagrams are examples of control configurations of the AGC_S, the AGC_Ve, the ATR_S, and the ATR_Ve. Therefore, it is also possible to configure the control system by a configuration other than these control configurations. For example, in FIG. 3, respective control systems are represented by integral control (I control). The respective control systems may be represented by proportional-integral control (PI control) or proportional-integral-differential control (PID control).

As shown in FIG. 3, a delivery-side plate thickness deviation Δh is input to the first plate thickness control part 51. The delivery-side plate thickness deviation Δh is expressed by a difference between an actual result hfb of the material to be rolled 10 in the delivery side of the rolling stand 21 and its preset value (a target value) href (Δh=hfb−href). The first plate thickness control part 51 integrates the delivery-side plate thickness deviation Δh multiplied by an adjustment gain $G_{SAGC}$ and a conversion gain (−(M+Q)/M) (I control). This conversion gain is a gain for converting the delivery-side plate thickness deviation Δh into a roll gap correction amount ΔS. "M" contained in the conversion gain is a mill constant of the rolling stand, and "Q" is a plastic constant of the material to be rolled. The first plate thickness control part 51 calculates a deviation between the integral value and its previous value and sets the deviation as a roll gap control amount $\Delta\Delta S_{AGC}$.

Similar to the first plate thickness control part 51, the delivery-side plate thickness deviation Δh is input to the second plate thickness control part 52. The second plate thickness control part 52 integrates the delivery-side plate thickness deviation Δh multiplied by an adjustment gain $G_{VAGC}$ and a conversion gain (−1/href) (I control). This conversion gain is a gain for converting the delivery-side plate thickness deviation Δh into a speed correction amount ΔVe. The second plate thickness control part 52 calculates a deviation between a value (ΔVe/Ve) obtained by dividing the integral value by the velocity Ve and its previous value, and sets the deviation as the speed control amount $\Delta(\Delta Ve/Ve)_{AGC}$.

To the second tension control part 54, the entry-side tension deviation ΔTb is input. The entry-side tension deviation ΔTb is expressed by a difference between an actual result Tbfb of the tension of the material to be rolled 10 in the entry side of the rolling stand 21 and its preset value (a target value) ΔTbref (ΔTb=Tbfb−Tbref). The second tension control part 54 integrates the entry-side tension deviation ΔTb multiplied by an adjustment gain $G_{SATR}$ and a conversion gain ((M+Q)*kb/M) (I control). This conversion gain is a gain for converting the entry-side tension deviation ΔTb into a roll gap correction amount ΔS. "kb" included in the conversion gain is an influence coefficient that indicates a fluctuation of load P due to the fluctuation of the tension of the material to be rolled on the entry side of the rolling stand affects the plate thickness of the material to be rolled in the delivery side of the rolling stand. The second tension control part 54 calculates a deviation between the integral value and its previous value and sets it as a roll gap control amount $\Delta\Delta S_{ATR}$.

Similar to the second tension control part 54, the entry-side tension deviation ΔTb is input to the first tension control part 53. The first tension control part 53 integrates the entry-side tension deviation ΔTb multiplied by an adjustment gain $G_{VATR}$ and a conversion gain (−Ve·kb/h) (I control). This conversion gain is a gain for converting the entry-side tension deviation ΔTb to the speed correction amount ΔVe. The first tension control part 53 calculates a deviation between a value (ΔVe/Ve) obtained by dividing the integral value by the velocity Ve and its previous value, and sets it a speed control amount $\Delta(\Delta Ve/Ve)_{ATR}$.

Returning to FIG. 1, an inner function of the rolling controller 50 will be explained. The control selection part 55 switches the combination of the AGC and the ATR described above in accordance with the rolling speed. Specifically, when the rolling speed is less than the boundary value TH, the combination of the AGC_S and the ATR_Ve is selected. If the rolling speed is greater than or equal to the boundary value TH, the combination of the AGC_Ve and the ATR_S is selected.

Figure 4:
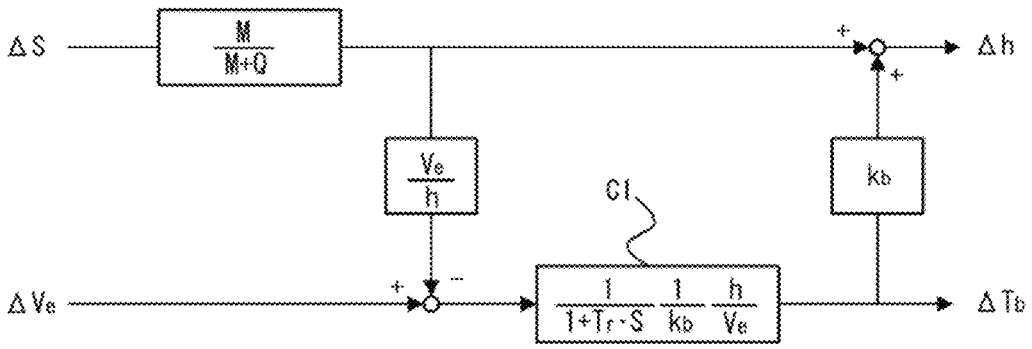
FIG. 4 is a diagram showing a relationship between a control operation terminal of the AGC or the ATR and control status amount.

The reason why such switching is performed in the control selection part 55 will be described referring to FIGS. 4 and 5. FIG. 4 is a diagram showing a relationship between the control operation terminal in the AGC or the ATR and control status amount. As shown in FIG. 4, when the roll gap correction amount ΔS, which is the control operation terminal, is operated, the velocity Ve changes accordingly, and the entry-side tension deviation ΔTb is generated. In order to suppress this, it is necessary to change the speed Ve. However, if the velocity Ve, which is the control operation terminal, is operated, the plate thickness h in the delivery side of the rolling stand fluctuates in accordance with the velocity Ve. An influence coefficient C1 is the influence coefficient exerted by a rolling phenomenon system in the entry side of the rolling stand. "Tr" included in the influence coefficient C1 is a first-order lag constant. "E" included in the first-order lag constant Tr is a Young's modulus, and "b" is a plate width.

Figure 5:
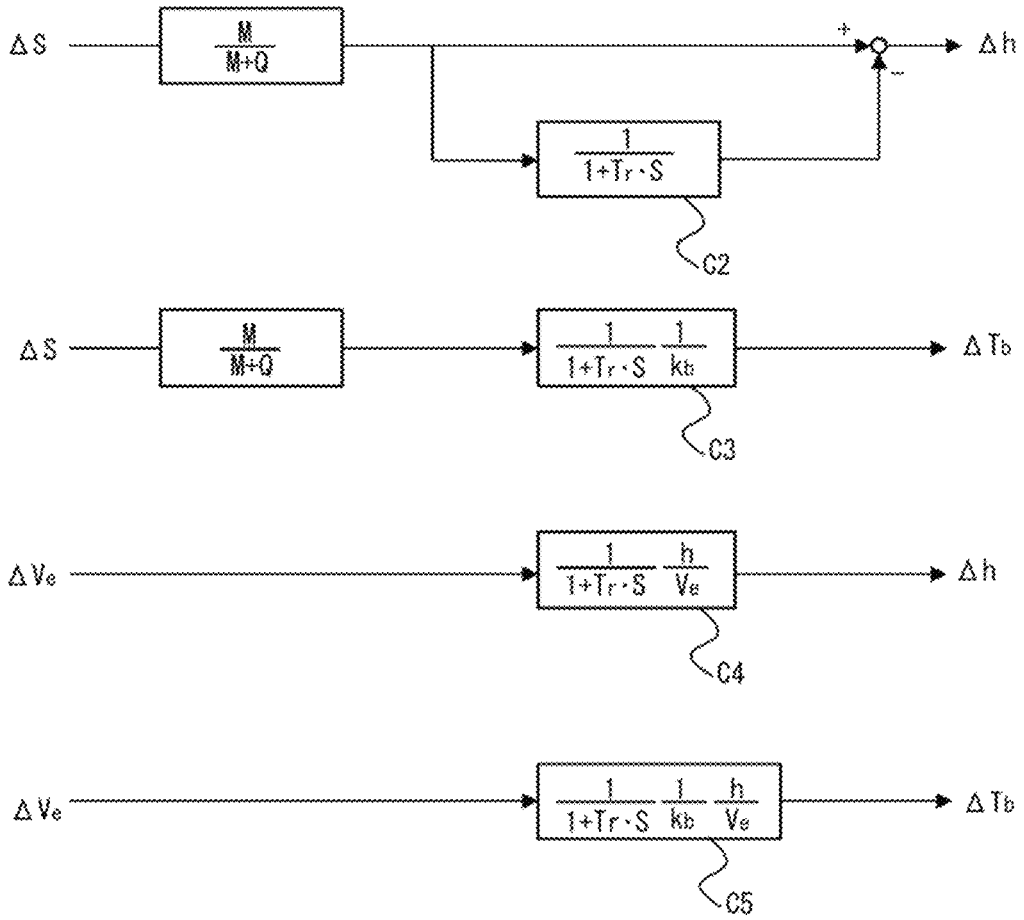
FIG. 5 is a diagram showing various influence coefficients in the rolling phenomenon in the rolling stand.

FIG. 5 is a diagram showing various influence coefficients in the rolling phenomenon in the rolling stand. The influence coefficient C2 shown in the first stage of FIG. 5 is the influence coefficient of the roll gap correction amount ΔS in the delivery-side plate thickness deviation Δh. The influence coefficient C3 shown in the second stage is the influence coefficient of the roll gap correction amount ΔS in the entry-side tension deviation ΔTb. The influence coefficient C4 shown in the third stage is the influence coefficient of the speed correction amount ΔVe in the delivery-side plate thickness deviation Δh. The influence coefficient C5 shown in the fourth stage is the influence coefficient of the speed correction amount ΔVe in the entry-side tension deviation ΔTb.

The influence coefficients C4 and C5 include the speed V e in the denominator. Therefore, the influence coefficients C4 and C5 become smaller when the rolling speed is in a high-speed region. The velocity Ve is also included in the denominator of the first-order lag constant Tr (see FIG. 4). Therefore, when the rolling speed is in the high-speed region, the first-order lag constant Tr becomes smaller. The first-order lag constant Tr is included in the denominators of the influence coefficients C2 and C3. Therefore, when the rolling speed is in the high-speed region, the influence coefficients C2 and C3 become large.

In summary, when the rolling speed is in the high speed region, the influence coefficients C4 and C5 become smaller while the influence coefficients C2 and C3 become larger. In addition, the influence coefficient C2 is a subtraction element of the delivery-side plate thickness deviation Δh. Therefore, when the rolling speed is in the high-speed region, it can be understood that the entry-side tension deviation ΔTb tends to change according to the roll gap correction amount ΔS. On the other hand, it can be understood that the entry-side tension deviation ΔTb and the delivery-side plate thickness deviation Δh do not change so much when the speed correction amount ΔVe changes. It can also be understood that even when the roll gap correction amount ΔS changes, the delivery-side plate thickness deviation Δh does not change so much.

The above-mentioned relationship has an opposite content when the rolling speed is in the low-speed region. That is, when the rolling speed is in the low-speed region, the entry-side tension deviation ΔTb does not change so much even when the roll gap correction amount ΔS changes. On the other hand, the entry-side tension deviation ΔTb and the delivery-side plate thickness deviation Δh is likely to change depending on the speed correction amount ΔVe. And the delivery-side plate thickness deviation Δh is likely to change according to the roll gap correction amount ΔS.

From the above, it can be understood that when the rolling speed is in the low speed region, the variation of the roll gap S is valid for the AGC. Therefore, when the rolling speed is less than the boundary value TH, the AGC by using the roll gap S as the control operation terminal (i.e., the AGC_S) is executed. At the same time, the ATR by using the velocity Ve as the control operation terminal (i.e., the ATR_Ve) is executed. Conversely, if the rolling speed is greater than or equal to the boundary value TH, the AGC by using the velocity Ve as the control operation terminal (i.e., the AGC_Ve) is executed. At the same time, the ATR by using the roll gap S as the control operation terminal (i.e., the ATR_S) is executed.

3. Feature of Configuration of Control Selection Part

The ATR_Ve, which is executed when the rolling speed is less than the boundary value TH, is executed from a startup of the rolling stand. For this reason, the speed correction amount ΔVe in the ATR_Ve may show a large value depending on the situation of the startup. If the rolling speed exceeds the boundary value TH in such a situation, in accompany with the switching of the AGC and the ATR, the speed control amount $\Delta(\Delta Ve/Ve)_{AGC}$ in the AGC_Ve will be calculated by using the speed correction amount ΔVe is used. As a result, the speed control amount $\Delta(\Delta Ve/Ve)_{AGC}$ may conflict with the upper restriction.

Figure 6:
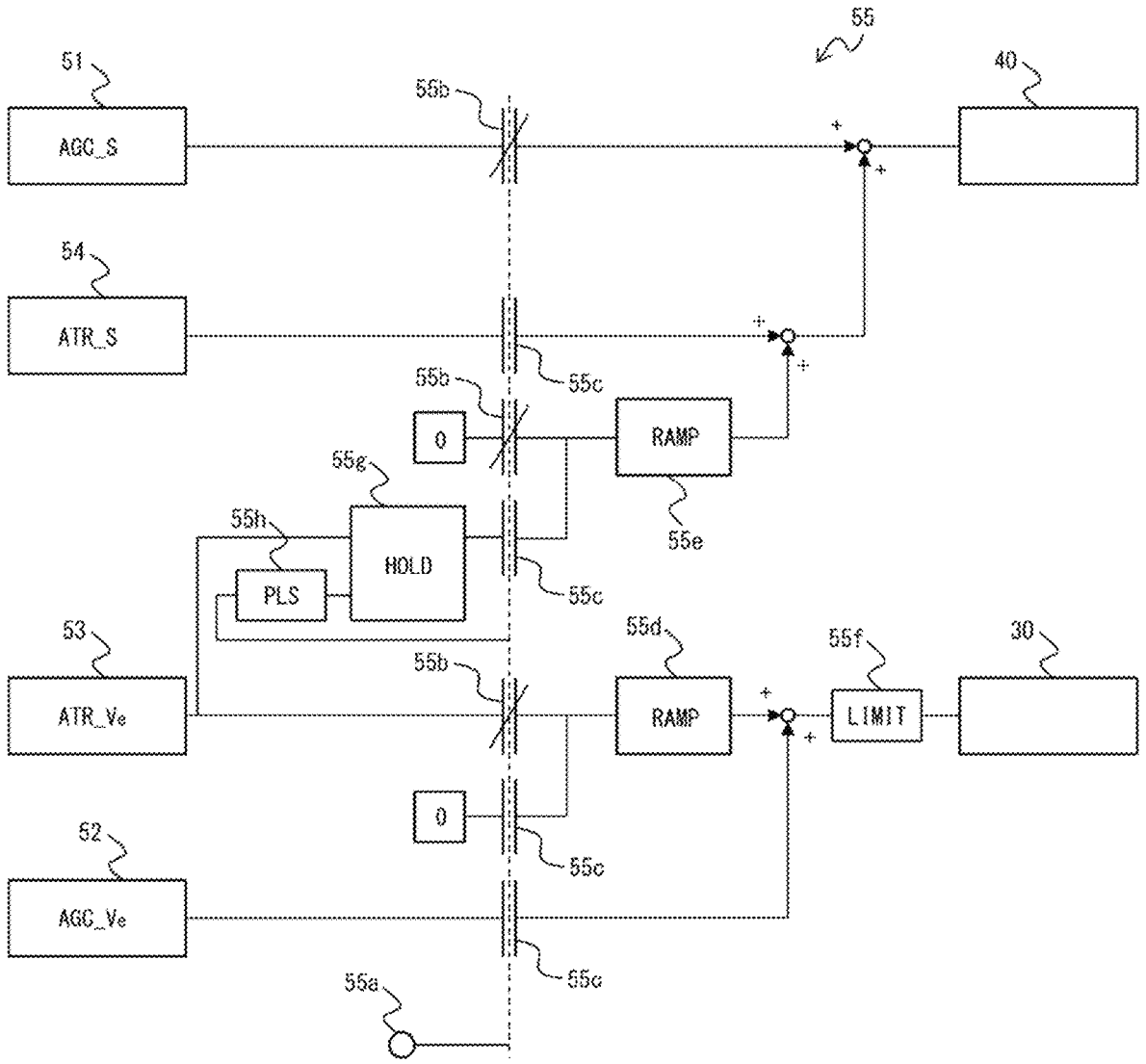
FIG. 6 is a block diagram showing a configuration of a control selection part shown in FIG. 1.

Therefore, in the embodiment, the control selection part 55 is configured as follows. FIG. 6 is a block diagram showing a configuration of the control selection part 55. As shown in FIG. 6, the control selection part 55 includes a trigger circuit 55*a*, switches 55*b* and 55*c*, RAMP circuits 55*d* and 55*e*, a limiter 55*f*, a HOLD circuit 55*g*, and a pulse generator 55*h*.

The trigger circuit 55*a* outputs a trigger signal when the rolling speed is equal to or greater than the boundary value TH. When the trigger signal is output, the switch 55*b* is switched from "ON" to "OFF". That is, prior to the output of the trigger signal, the roll gap control amount $\Delta\Delta S_{AGC}$ which is output from the first plate thickness control part 51 is input to the roll gap controller 40. After the output of the trigger signal, this input is blocked by the switch 55*b*.

Prior to the output of the trigger signal, the speed control amount $\Delta(\Delta Ve/Ve)_{ATR}$ which is output from the first tension control part 53 is also input to the RAMP circuit 55*d*. The speed correction amount ΔVe which is used to calculate the speed control amount $\Delta(\Delta Ve/Ve)_{ATR}$ is also input to the RAMP circuit 55*d*. The speed control amount $\Delta(\Delta Ve/Ve)_{ATR}$ input to the RAMP circuit 55*d* is input to the limiter 55*f*. The limiter 55*f* inputs the upper restriction to the speed controller 30 when the speed control amount $\Delta(\Delta Ve/Ve)_{ATR}$ input to the limiter 55*f* conflicts with the upper restriction. Otherwise, the limiter 55*f* inputs the speed control amount $\Delta(\Delta Ve/Ve)_{ATR}$ into the speed controller 30.

When the trigger signal is output, the switch 55*c* is switched from "OFF" to "ON". Then, the speed control amount $\Delta(\Delta Ve/Ve)_{AGC}$ output from the second plate thickness control part 52 is input to the limiter 55*f*. Here, when the trigger signal is output, zero is input to the RAMP circuit 55*d* via the switch 55*c*. Therefore, the RAMP circuit 55*d* resets the speed control amount $\Delta(\Delta Ve/Ve)_{ATR}$ which is output from the first tension control part 53 prior to the output of the trigger signal and resets the speed correction amount ΔVe which is used to calculate the speed control amount $\Delta(\Delta Ve/Ve)_{ATR}$. Then, after outputting the trigger signal, nothing is output from the RAMP circuit 55*d* to the limiter 55*f*.

Therefore, after the output of the trigger signal, only the speed control amount $\Delta(\Delta Ve/Ve)_{AGC}$ output from the second plate thickness control part 52 is input to the limiter 55*f*. After the output of the trigger signal, the limiter 55*f* inputs the upper restriction to the speed controller 30 when the speed control amount $\Delta(\Delta Ve/Ve)_{AGC}$ input to the limiter 55*f* conflicts with the upper restriction. Otherwise, the limiter 55*f* inputs the speed control amount $\Delta(\Delta Ve/Ve)_{AGC}$ to the speed controller 30.

The HOLD circuit 55*g* stores the speed correction amount ΔVe which is output from the first tension control part 53. The speed correction amount ΔVe is stored in association with pulsed output signals from the pulse generator 55*h*. When the trigger signal is output, the speed correction amount ΔVe at this outputting is input from the HOLD circuit 55*g* to the RAMP circuit 55*e*. The RAMP circuit 55*e* calculates and outputs the roll gap correction amount ΔS equivalent to the speed correction amount ΔVe which is input to the RAMP circuit 55*e*. This roll gap correction amount ΔS is calculated by multiplying the speed correction amount ΔVe by a predetermined adjustment gain.

After the trigger signal is output, the roll gap amount $\Delta\Delta S_{ATR}$ which is output from the second tension control part 54 is input to the roll gap controller 40 via the switch 55*c*. At the outputting of the trigger signal, the roll gap correction amount ΔS which is calculated in the RAMP circuit 55*e* is added to the roll gap control amount $\Delta\Delta S_{ATR}$. That is, at the outputting of the trigger signal, the roll gap correction amount Δ S is added to the roll gap control amount $\Delta S_{ATR}$ is input to the roll gap controller 40.

4. Effect

According to the embodiment described above, the speed control amount $\Delta(\Delta Ve/Ve)_{ATR}$ that is output from the first tension control part 53 and the speed correction amount ΔVe that is used for calculating the speed control amount $\Delta(\Delta Ve/Ve)_{ATR}$ are reset when the rolling speed exceeds the boundary value TH value. Therefore, after the timing at which the rolling speed exceeds the boundary value TH, only the speed control amount $\Delta(\Delta Ve/Ve)_{AGC}$ output from the second plate thickness control part 52 is input to the limiter 55*f*. Therefore, it is possible to avoid a situation where the speed control amount $\Delta(\Delta Ve/Ve)_{AGC}$ conflicts with the upper restriction. Therefore, it is possible to avoid a situation where it becomes difficult to continue the AGC after the timing at which the rolling speed exceeds the boundary value TH.

Here, consider a case where the speed correction amount ΔVe that loosens the tension Tb is output from the first tension control part 53 just before the timing at which the rolling speed exceeds the boundary value TH. If such the speed correction amount ΔVe is ignored, the tension Tb immediately after the rolling speed exceeds the boundary value TH becomes tensile. In this regard, according to the embodiment, the roll gap correction amount ΔS equivalent to the speed correction amount ΔVe at the timing when the rolling speed exceeds the boundary value TH is added to the roll gap control amount $\Delta S_{ATR}$. Therefore, it is also possible to suppress a large change in the tension Tb after the timing at which the rolling speed exceeds the boundary value TH.

5. Other Embodiments

In the above embodiment, the first plate thickness control part 51 and the like have been described as functions of the rolling controller 50. However, these functions may be implemented separately in a plurality of control devices.

In the above embodiment, the processing executed by the rolling controller 50 is applied to tandem rolling mill. However, this processing may be applied to a single stand rolling mill. In this instance, velocity of a tension reel provided in a front stage or a rear stage of the rolling stand may be controlled by a speed controller, and a roll gap of this rolling stand may be controlled by a roll gap controller.

REFERENCE SIGNS LIST

10 Material to be rolled
20, 21 Rolling stand
30, 31 Speed controller
40, 41 Roll gap controller
50 Rolling controller
51 First plate thickness control part
52 Second plate thickness control part
53 First tension control part
54 Second tension control part
55 Control selection part
60 Plate thickness meter
70 Tension meter
100 Rolling control system
H, h Plate thickness
S Roll gap
Tb, Tf Tension
Ve, Vo Speed

The invention claimed is:

1. A rolling control system comprising:

a rolling stand; and a rolling controller configured to execute speed control of which a control operation terminal is speed of a material to be rolled in an entry side of the rolling stand and roll gap control of which a control operation terminal is a roll gap of the rolling stand, wherein the rolling controller includes:

a first plate thickness control part configured to execute roll gap and plate thickness control that is roll gap control to control a plate thickness of the material to be rolled in a delivery side of the rolling stand;

a second plate thickness control part configured to execute speed and plate thickness control that is speed control to control the plate thickness;

a first tension control part configured to execute speed and tension control to control a tension of the material to be rolled in the entry side of the rolling stand;

a second tension control part configured to execute roll gap and plate tension control to control the tension; and a control selection part configured to select the speed and tension control and the roll gap and plate thickness control if rolling speed is less than a boundary value, while selecting the roll gap and plate tension control and the speed and plate thickness control if the rolling speed is greater than or equal to the boundary value, wherein the control selection part is further configured to:

if the rolling speed rises across the boundary value at a startup of the rolling stand, set a speed correction amount to zero and then output it to the second tension control part such that the speed correction amount in the speed and tension control before a transboundary is not reflected to a calculation executed in the speed control amount of the rolling speed at the transboundary; and if the rolling speed rises across the boundary value at the startup of the rolling stand, calculate a roll gap correction amount according to the speed correction amount and then output it to the second tension control part such that the speed correction amount is reflected to a calculation of a roll gap control amount executed in the roll gap and plate tension control at the transboundary, wherein the control selection part includes:

a hold circuit configured to store the speed correction amount output in the speed and tension control from the first tension control part;

a trigger circuit configured to output a trigger signal when the rolling speed is equal to or greater than the boundary value; and a ramp circuit configured to, when the trigger signal is output from the trigger circuit, calculate the roll gap correction amount according to the speed correction amount based on the speed correction amount output in the speed and tension control at which the trigger signal is output from the trigger circuit.

2. The rolling control system according to claim 1, wherein the roll gap control amount output from the first plate thickness control part is input to the roll gap control, before the trigger signal is output from the trigger circuit, and the input of the roll gap control amount output from the first plate thickness control part is blocked by a switch, after the trigger signal is output from the trigger circuit.

3. The rolling control system according to claim 2, wherein the roll gap correction amount calculated by the ramp circuit is added to the roll gap control amount output from the second tension control part, and the combined amount of the roll gap correction amount calculated by the ramp circuit and the roll gap control amount output from the second tension control part is input to the roll gap control, after the trigger signal is output from the trigger circuit.

4. The rolling control system according to claim 1, wherein the control selection part further includes another ramp circuit and a limiter, a speed control amount output from the first tension control part and a speed correction amount that is used for calculation of the speed control amount is input to the other ramp circuit, and the limiter is configured to input, to the speed control, the speed control amount output from the first tension control part, before the trigger signal is output from the trigger circuit.

5. The rolling control system according to claim 4, wherein the limiter inputs an upper restriction parameter to the speed control, under a condition that the speed control amount output from the first tension control part meets the upper restriction.

6. The rolling control system according to claim 4, wherein the limiter inputs, to the speed control, a speed control amount output from the second plate thickness control part, after the trigger signal is output from the trigger circuit.

7. The rolling control system according to claim 6, wherein the limiter inputs an upper restriction parameter to the speed control, under a condition that the speed control amount output from the second plate thickness control part meets the upper restriction.

8. The rolling control system according to claim 4, wherein the other ramp circuit is configured to reset the speed control amount output from the first tension control part and the speed correction amount that is used for calculation of the speed control amount, after the trigger signal is output from the trigger circuit.

9. A rolling control method comprising:

executing speed control of which a control operation terminal is rolling speed; and executing roll gap control of which a control operation terminal is a roll gap of a rolling stand, wherein the roll gap control includes:

roll gap and plate thickness control which is the roll gap control to control a plate thickness of a material to be rolled in a delivery side of the rolling stand; and roll gap and plate tension control which is the roll gap control to control a tension of the material to be rolled in an entry side of the rolling stand, wherein the speed control includes:

speed and tension control which is the speed control to control the tension; and speed and plate thickness control which is the speed control to control the plate thickness, wherein the rolling control method further comprising:

selecting, if rolling speed of the material to be rolled is less than a boundary value, the speed and tension control and the roll gap and plate thickness control;

selecting, if the rolling speed is greater than or equal to the boundary value, the roll gap and plate tension control and the speed and plate thickness control;

setting a speed correction amount to zero, if the rolling speed rises across the boundary value at the startup of the rolling stand, such that the speed correction amount in the speed and tension control before a transboundary is not reflected to a calculation executed in the speed control amount of the rolling speed at the transboundary; and calculating, if the rolling speed rises across the boundary value at the startup of the rolling stand, a roll gap correction amount according to the speed correction amount such that the speed correction amount is reflected to a calculation of a roll gap control amount executed in the roll gap and plate tension control at the transboundary, wherein the rolling control method further comprising:

storing the speed correction amount output in the speed and tension control; and outputting a trigger signal when the rolling speed is equal to greater than the boundary value, wherein, when calculating the roll gap correction amount according to the speed correction amount, the roll gap correction amount is calculated based on the speed correction amount output in the speed and tension control at which the trigger signal is output.

* * * * *